US010712683B1

(12) United States Patent
Miyakoshi et al.

(10) Patent No.: US 10,712,683 B1
(45) Date of Patent: Jul. 14, 2020

(54) IMAGE FORMING APPARATUS

(71) Applicant: FUJI XEROX CO., LTD., Tokyo (JP)

(72) Inventors: Yukiko Miyakoshi, Kanagawa (JP); Miho Ikeda, Kanagawa (JP); Shinji Okuyama, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 16/515,677

(22) Filed: Jul. 18, 2019

(30) Foreign Application Priority Data

Mar. 19, 2019 (JP) ..... 2019-051423

(51) Int. Cl.
*G03G 15/01* (2006.01)
*G03G 15/02* (2006.01)

(52) U.S. Cl.
CPC ..... *G03G 15/0131* (2013.01); *G03G 15/02* (2013.01)

(58) Field of Classification Search
CPC ..... G03G 15/0131; G03G 15/02; G03G 15/1675; G03G 15/1645
See application file for complete search history.

(56) References Cited

U.S. PATENT DOCUMENTS 7,650,089 B2 * 1/2010 Borton ..... G03G 15/0121 399/223
9,547,249 B2 1/2017 Kochi
2003/0072579 A1 * 4/2003 Bessho ..... G03G 15/0131 399/44

FOREIGN PATENT DOCUMENTS

JP 2006-259142 A 9/2006
JP 2014-102443 A 6/2014
JP 2016-071315 A 5/2016

* cited by examiner

*Primary Examiner* — Sandra Brase
(74) *Attorney, Agent, or Firm* — Sughrue Mion, PLLC

(57) ABSTRACT

An image forming apparatus includes an image holding body that holds an image to be transferred to a recording material; a developing unit that causes a mixture, in which plural kinds of developers are mixed, to adhere to the image holding body and that forms an image on the image holding body; a transfer unit that transfers an image formed on the image holding body to a recording material; and a change portion that changes a transfer condition that is a condition under which the transfer unit performs transfer so that a ratio of the plural kinds of developers in the image to be transferred to a recording material becomes close to a predetermined ratio.

11 Claims, 7 Drawing Sheets

FIG. 4A
YELLOW (LARGE DIAMETER) (6.5 μm) :
GREEN (SMALL DIAMETER) (5.5 μm)
= 50:50
FIG. 4B
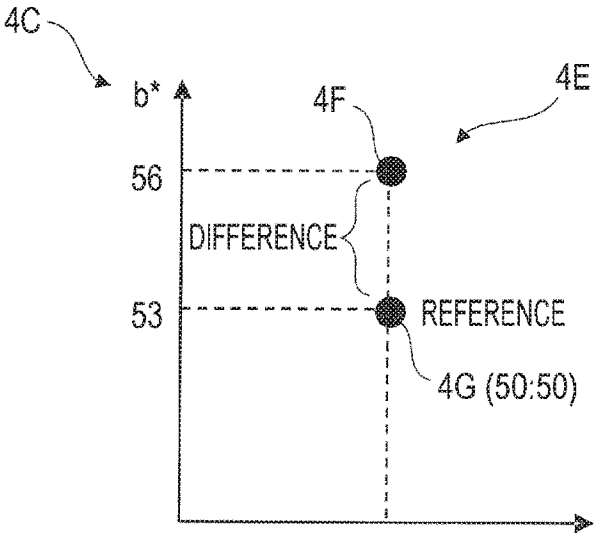
FIG. 4C
| | TRANSFER VOLTAGE | b* |
|---|---|---|
| TARGET | | 53 |
| NORMAL MODE | 2.6 kV | 56 |
| AFTER CHANGE IN CONDITION | 2.1 kV | 53 |
4H
CHANGE TRANSFER CONDITION
FIG. 4D
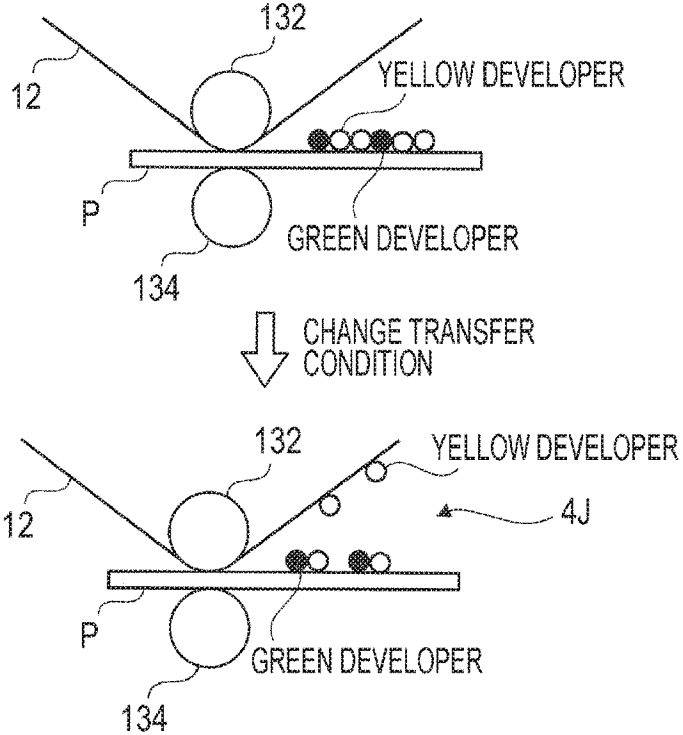

FIG. 5A
COLORLESS AND TRANSPARENT (SMALL DIELECTRIC LOSS) : BLACK (LARGE DIELECTRIC LOSS) = 50:50
FIG. 5B
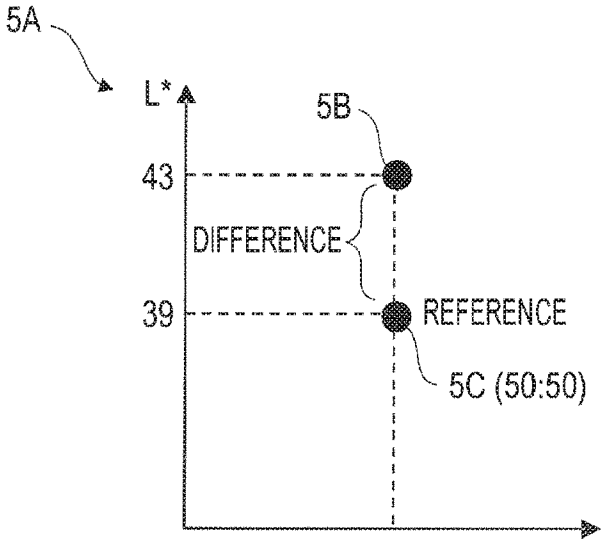
FIG. 5C
| | TRANSFER VOLTAGE | b* |
|---|---|---|
| TARGET | | 39 |
| NORMAL MODE | 2.6 kV | 43 |
| AFTER CHANGE IN CONDITION | 1.6 kV | 39 |
5D CHANGE TRANSFER CONDITION
FIG. 5D
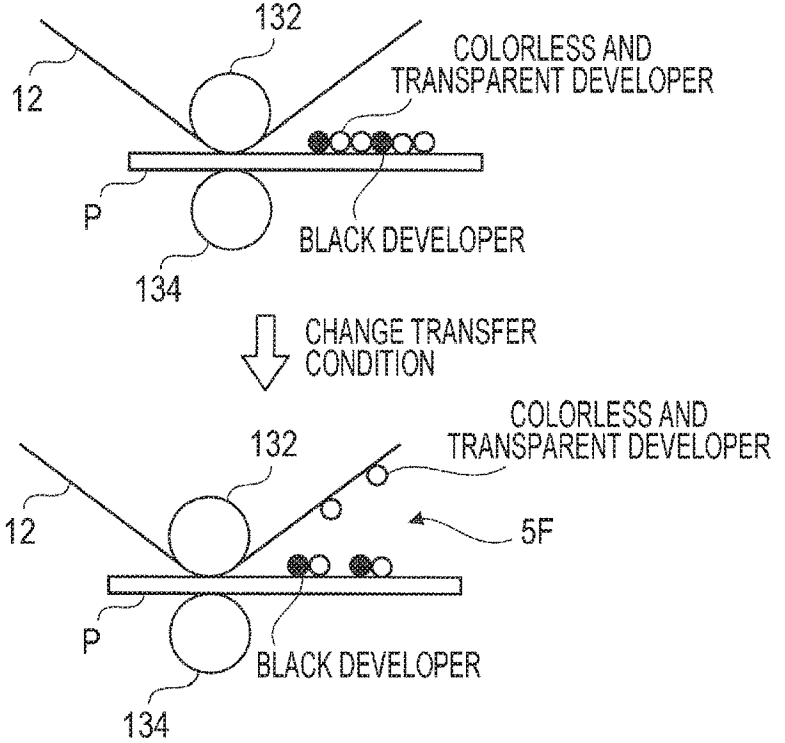

IMAGE FORMING APPARATUS

CROSS-REFERENCE TO RELATED APPLICATIONS

This application is based on and claims priority under 35 USC 119 from Japanese Patent Application No. 2019-051423 filed Mar. 19, 2019.

BACKGROUND

(i) Technical Field

The present disclosure relates to an image forming apparatus.

(ii) Related Art

Japanese Unexamined Patent Application Publication No. 2006-259142 discloses a process of determining the deviation between colorimetric values of RGB that represent a secondary color and corresponding target color values, and determining presence of insufficiency of second transfer or insufficiency of fixing.

Japanese Unexamined Patent Application Publication No. 2016-71315 discloses a process of decreasing the second transfer pressure when a superimposed toner image includes an extra color toner in comparison that when a superimposed toner image does not include an extra color toner.

Japanese Unexamined Patent Application Publication No. 2014-102443 discloses a process of measuring the color tone of a toner image, specifying the direction in which the color tone is deviated from a reference value, and controlling the second transfer voltage of a second transfer portion so that the deviation is corrected.

SUMMARY

When an image is formed by using a mixture in which plural kinds of developers are mixed, the respective developers may be included in an image to be formed with a ratio different from the intended ratio, due to the difference in characteristics among the developers. In this case, for example, an image is formed with a color different from the intended color, resulting in deterioration in quality of the image to be formed.

Aspects of non-limiting embodiments of the present disclosure relate to suppressing the deterioration in quality of an image to be formed using a mixture in which plural kinds of developers are mixed, as compared with a case where the process of suppressing the deterioration in quality of an image due to the use of the mixture in which the plural kinds of developers are mixed is not performed.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided an image forming apparatus including an image holding body that holds an image to be transferred to a recording material; a developing unit that causes a mixture, in which a plurality of kinds of developers are mixed, to adhere to the image holding body and that forms an image on the image holding body; a transfer unit that transfers an image formed on the image holding body to a recording material; and a change portion that changes a transfer condition that is a condition under which the transfer unit performs transfer so that a ratio of the plurality of kinds of developers in the image to be transferred to a recording material becomes close to a predetermined ratio.

BRIEF DESCRIPTION OF THE DRAWINGS

An exemplary embodiment of the present disclosure will be described in detail based on the following figures, wherein:

FIGS. 4A to 4D are diagrams each illustrating a specific example of a change process of a transfer condition;

FIGS. 5A to 5D are diagrams each illustrating another example of the change process of the transfer condition;

DETAILED DESCRIPTION

An exemplary embodiment of the disclosure will now be described in detail with reference to the accompanying drawings.

Figure 1:
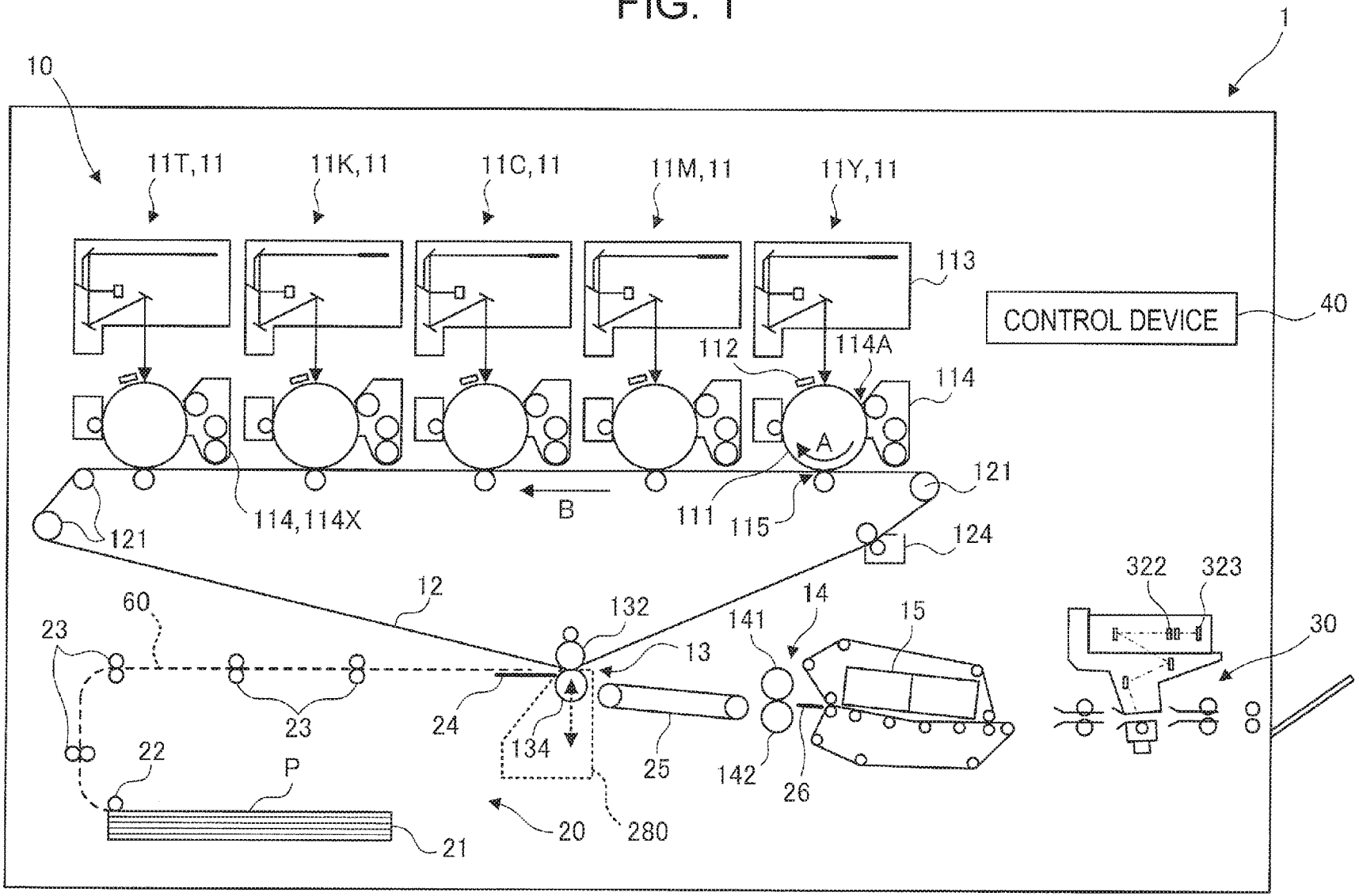
FIG. 1 is a diagram illustrating an image forming apparatus.

FIG. 1 is a diagram illustrating an image forming apparatus 1 according to an exemplary embodiment of the disclosure.

The image forming apparatus 1 according to this exemplary embodiment includes an image forming section 10, a sheet transport unit 20, an image reading unit 30, and a control device 40.

The image forming section 10 includes plural image forming units 11 (11Y, 11M, 11C, 11K, and 11T), an intermediate transfer belt 12, a second transfer portion 13, a fixing unit 14, and a cooler 15.

In this exemplary embodiment, the five image forming units 11Y, 11M, 11C, 11K, and 11T respectively corresponding to five colors of yellow (Y), magenta (M), cyan (C), black (K), and extra color (T) are provided as the image forming units 11.

The five image forming units 11 are arranged side by side in a moving direction of the intermediate transfer belt 12.

Each of the image forming units 11 includes a photoconductor drum 111, a charging device 112, an exposure device 113, and a developing device 114, and forms an image by using an electrophotographic system.

More specifically, each of the image forming units 11 forms an image formed with a developer including a toner on the intermediate transfer belt 12. In this exemplary embodiment, a two-component developer including a toner and a carrier is used as a developer.

That is, in this exemplary embodiment, the image forming units 11 form images of the colors of YMCK and an image of the extra color. In this exemplary embodiment, the formed images are transferred to the intermediate transfer belt 12.

Thus, the images of the colors of YMCK and the image of the extra color are formed on the intermediate transfer belt 12.

The photoconductor drum 111 as an example of an image holding body rotates in a direction indicated by arrow A in the figure at a predetermined speed. In addition, the charging device 112 charges the surface of the photoconductor drum 111 with electricity. Further, the exposure device 113 irradiates the charged surface of the photoconductor drum 111 with light.

Thus, an electrostatic latent image corresponding to the formed image is formed on the outer peripheral surface of the photoconductor drum 111.

Then, the developing device 114, which is an example of a developing unit, performs development on the photoconductor drum 111 to form an image on the photoconductor drum 111.

More specifically, the developing device 114 causes the developer to adhere to the surface of the photoconductor drum 111 on which the electrostatic latent image is formed, thereby forming an image on the surface of the photoconductor drum 111.

In each of the image forming units 11Y, 11M, 11C, 11K, and 11T, corresponding one of images of yellow, magenta, cyan, black, and extra color is formed on the surface of the photoconductor drum 111.

In the developing device 114 provided in the image forming unit 11T (hereinafter, referred to as "extra-color developing device 114X"), a mixture in which two kinds of developers are mixed is used to perform development on the photoconductor drum 111.

In other words, in the image forming unit 11T, a mixture in which two or more kinds of developers having different colors are mixed is used to form an image of an extra color that is a color other than yellow, magenta, cyan, and black, on the surface of the photoconductor drum 111.

That is, in the image forming unit 11T, a mixture in which two or more kinds of developers having different colors is caused to adhere to the photoconductor drum 111 to form an image on the photoconductor drum 111.

In the following description, the mixture stored in the extra-color developing device 114X includes two kinds of developers for example, but the mixture stored in the extra-color developing device 114X may include three or more kinds of developers.

The image formed on each of the photoconductor drums 111 is transferred onto a sheet P by the intermediate transfer belt 12 and a second transfer roller 134, which function as a transfer unit.

Specifically, in this exemplary embodiment, the image formed on each of the photoconductor drums 111 is transferred (first transfer) onto the intermediate transfer belt 12 at a first transfer portion 115. Thus, a color image including plural colors is formed on the intermediate transfer belt 12.

The intermediate transfer belt 12 is supported by plural roller-shaped members 121. In addition, the intermediate transfer belt 12 circularly moves in a direction indicated by arrow B in the figure.

The image formed on the intermediate transfer belt 12 moves to the second transfer portion 13 by the movement of the intermediate transfer belt 12. The image moved to the second transfer portion 13 is transferred at the second transfer portion 13 to a sheet P as an example of a recording material that has been transported by the sheet transport unit 20.

The second transfer portion 13 is provided with the second transfer roller 134 that comes into contact with the outer peripheral surface of the intermediate transfer belt 12, and a backup roller 132 that is arranged inside the intermediate transfer belt 12 and that serves as a counter electrode of the second transfer roller 134.

In this exemplary embodiment, a voltage (hereinafter referred to as "second transfer voltage") is applied between the second transfer roller 134 and the backup roller 132, and the image on the intermediate transfer belt 12 is attracted toward the second transfer roller 134 by the second transfer voltage.

Thus, the image on the intermediate transfer belt 12 is transferred to the sheet P located between the intermediate transfer belt 12 and the second transfer roller 134.

Further, in this exemplary embodiment, a separation mechanism 280 is provided. The separation mechanism 280 moves the second transfer roller 134 away from the intermediate transfer belt 12 to separate the second transfer roller 134 from the intermediate transfer belt 12. The separation mechanism 280 is not particularly limited, and is constituted by a known mechanism.

Further, in this exemplary embodiment, a belt cleaner 124 is provided downstream of the second transfer portion 13 in the moving direction of the intermediate transfer belt 12. The belt cleaner 124 cleans the outer peripheral surface of the intermediate transfer belt 12 after second transfer.

The sheet transport unit 20 is provided with a sheet housing portion 21 that houses plural sheets P in a stacked state, and a feeding roller 22 that feeds out a sheet P housed in the sheet housing portion 21.

In addition, the sheet transport unit 20 is provided with a transport roller 23 that transports the sheet P fed out by the feeding roller 22 through a sheet transport path 60, and a guide member 24 that guides the sheet P transported by the transport roller 23 to the second transfer portion 13.

Further, the sheet transport unit 20 is provided with a transport belt 25 that transports the sheet P after second transfer to the fixing unit 14, and a guide member 26 that guides the sheet P after fixing to the cooler 15.

The fixing unit 14 is disposed downstream of the second transfer portion 13 in the transport direction of the sheet P. The fixing unit 14 includes a fixing roller 141 having a heating source (not illustrated), and a pressing roller 142 that is pressed against the fixing roller 141.

The sheet P that has passed through the second transfer portion 13 passes between the fixing roller 141 and the pressing roller 142. Thus, the sheet P is pressed and heated, and the image on the sheet P is fixed to the sheet P.

In this exemplary embodiment, the cooler 15 is provided downstream of the fixing unit 14. The cooler 15 cools the sheet P transported from the fixing unit 14.

The image reading unit 30 reads an image formed on the sheet P. More specifically, the image reading unit 30 reads the image transferred to the sheet P at the second transfer portion 13.

The image reading unit 30 is provided with a light source that emits light to the sheet P, an image sensor 323 that receives the light reflected from the sheet P, and an imaging lens 322 that guides the light reflected from the sheet P to the image sensor 323.

The image sensor 323 is constituted by, for example, a charge-coupled device (CCD) image sensor. Specifically, the image sensor 323 is provided with three line sensors corresponding to the three colors R, G, and B to detect the components of the three colors R, G, and B.

Each line sensor is provided along the main-scanning direction. In each line sensor, photoelectric conversion elements (photodiodes (PDs)) are arranged along the main-scanning direction.

The control device 40 includes a central processing unit (CPU), a read only memory (ROM), a random access memory (RAM), and a hard disk drive (HDD) (none of which is illustrated). The CPU executes a processing program. The ROM and the HDD store various programs, various tables, parameters, and the like. The RAM is used as a work area or the like at the time of execution of the processing program by the CPU.

Figure 2:
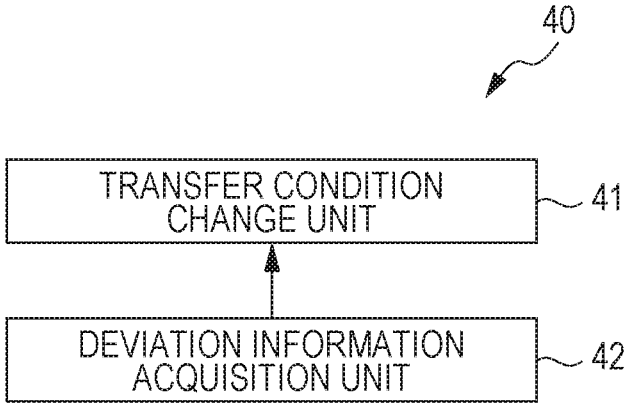
FIG. 2 is a diagram illustrating a functional unit realized by a control device.

FIG. 2 is a diagram illustrating a functional unit realized by the control device 40.

In this exemplary embodiment, the CPU executes the programs stored in the read only memory (ROM) and the HDD to thereby realize the functional units of a transfer condition change unit 41 and a deviation information acquisition unit 42.

The transfer condition change unit 41 as an example of a change portion changes a transfer condition that is a condition under which an image formed on the photoconductor drum 111 is transferred to a sheet P.

That is, the transfer condition change unit 41 changes a transfer condition that is a condition under which the intermediate transfer belt 12 and the second transfer roller 134, which function as the transfer unit, transfer an image to a sheet P.

The deviation information acquisition unit 42 as an example of a deviation information acquisition portion acquires information on a deviation of color in an image transferred to a sheet P.

In this exemplary embodiment, as described above, the image forming unit 11T forms an image by using the mixture in which the two or more kinds of developers are mixed.

In this case, due to the difference in characteristics on the developer basis (for example, the difference in charging characteristic), the respective developers may be included in the image formed on the sheet P at a ratio different from the intended ratio.

In this case, for example, an image is formed in a color different from the intended color, resulting in deterioration in quality of the image to be formed.

In this exemplary embodiment, when the respective developers are included in the image to be formed at a ratio different from the intended ratio, as will be described later, the transfer condition change unit 41 changes the transfer condition so that the ratio of the developers in the image to be transferred to the sheet P becomes close to a predetermined ratio (intended ratio).

More specifically, the transfer condition change unit 41 changes the transfer condition that is a condition under which transfer is performed at the second transfer portion 13.

Thus, the developer with an increased proportion is less likely transferred to the sheet P, and the respective developers are included in the image formed on the sheet P at a ratio close to the intended ratio.

Figure 3:
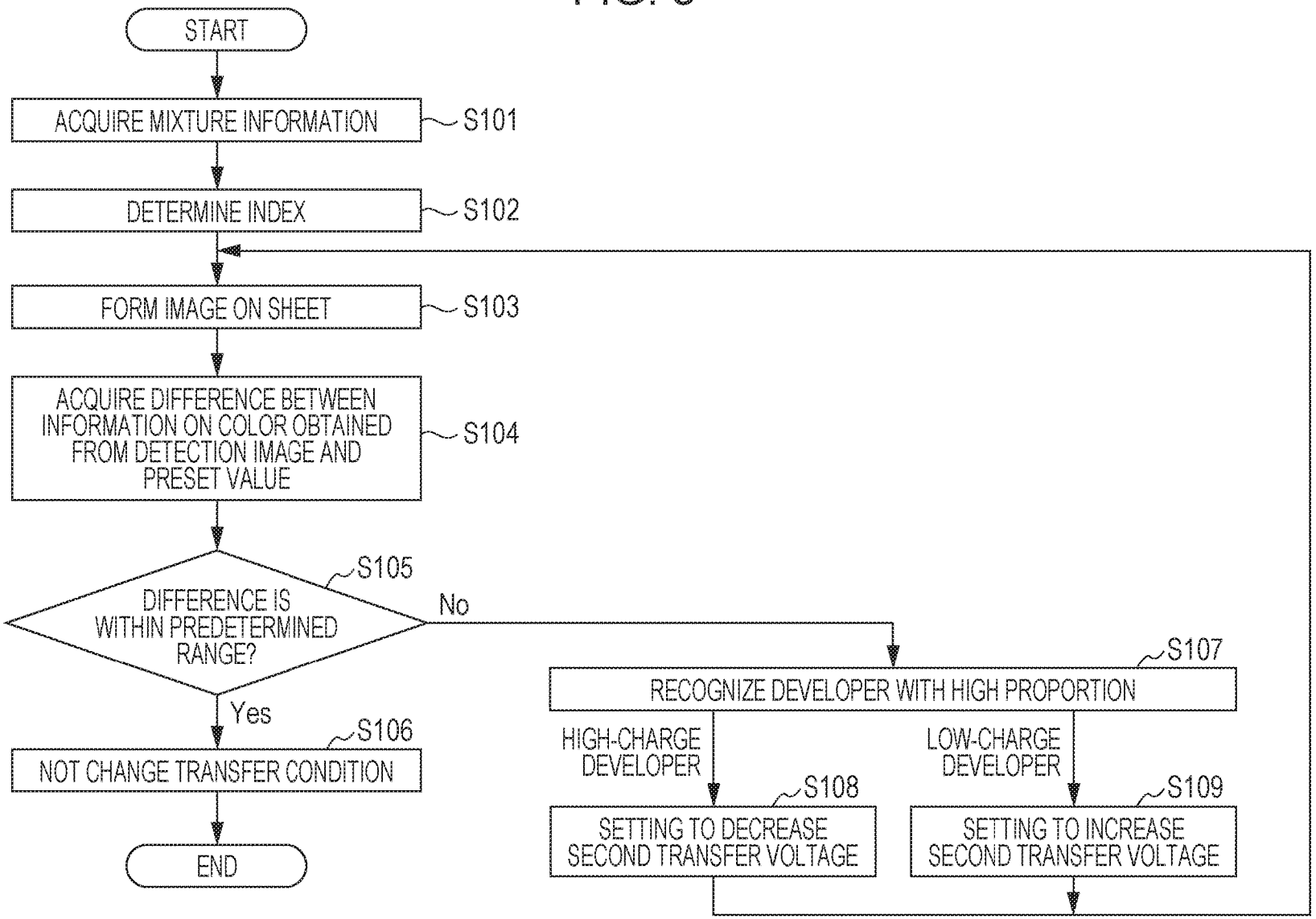
FIG. 3 is a flowchart illustrating a flow of processes that are executed by the image forming apparatus.

FIG. 3 is a flowchart illustrating a flow of processes that are executed by the image forming apparatus 1 according to this exemplary embodiment.

In this exemplary embodiment, first, the deviation information acquisition unit 42 acquires information on the mixture used in the extra-color developing device 114X (information on each of the plural kinds of developers) (hereinafter referred to as "mixture information") (step S101).

Specifically, the deviation information acquisition unit 42 acquires information read from an information storage medium (memory), and acquires mixture information.

More specifically, the deviation information acquisition unit 42 acquires information from an information storage medium (memory) attached to a cartridge (not illustrated) containing a mixture, and acquires mixture information.

More specifically, in this exemplary embodiment, a cartridge of each color is set in the image forming apparatus 1, and the developer is supplied to corresponding one of the image forming units 11 from the cartridge.

When acquiring the mixture information, the deviation information acquisition unit 42 acquires mixture information read from the information storage medium attached to the cartridge, and hence obtains the mixture information.

Then, in this exemplary embodiment, the deviation information acquisition unit 42 determines an index (details will be described later) to be used when acquiring information on the amount of deviation based on the acquired mixture information (step S102).

Specifically, in this exemplary embodiment, as will be described later, the deviation information acquisition unit 42 acquires information on the amount of deviation of color by using indices such as hue, brightness, and saturation. In step S102, the deviation information acquisition unit 42 determines the index to be used when acquiring the information on the amount of deviation of color.

That is, based on the mixture information, the deviation information acquisition unit 42 determines one index to be used when the deviation of color is detected, from among the plural indices.

Then, in this exemplary embodiment, the image forming unit 11T (extra-color developing device 114X) is used to form an image on a sheet P (step S103).

Thus, a deviation detection image that is used for detecting the deviation of color and that is formed by using the mixture is formed on the sheet P.

In this exemplary embodiment, the deviation information acquisition unit 42 analyzes the deviation detection image formed on the sheet P (analyzes the reading result of the image reading unit 30), and detects a deviation of color in the deviation detection image.

In other words, the deviation information acquisition unit 42 analyzes the deviation detection image formed on the sheet P, and acquires information on a deviation of color in an image to be transferred to a sheet P.

Specifically, the deviation information acquisition unit 42 acquires the difference between information on a color obtained from the deviation detection image and a preset value determined in advance for the color (step S104).

In other words, the deviation information acquisition unit 42 recognizes a comparison deviation that is a deviation of color in an image to be transferred onto a sheet P and that is a deviation of color when a color of an image to be formed with plural kinds of developers at the predetermined ratio (the ratio intended by a user) is set as a comparison target.

That is, when the image formed with the plural kinds of developers at the predetermined ratio (the ratio intended by the user) is set as a target image, the deviation information acquisition unit 42 recognizes a deviation of color occurring between the target image and the image actually transferred to the sheet P.

That is, the deviation information acquisition unit 42 recognizes a comparison deviation that is the deviation of color in the image to be transferred onto the sheet P and that is a deviation of color of the target image when the target image is used as a comparison object.

More specifically, when acquiring the information on the deviation (when acquiring the information on the comparison deviation), the deviation information acquisition unit 42 acquires image information on the Lab color space by performing a conversion process on a read image of the RGB color space obtained by the image reading unit 30 (a read image of the deviation detection image).

Then, the deviation information acquisition unit 42 acquires the difference between partial information included in the image information on the Lab color space and a preset value.

In this exemplary embodiment, it is determined whether or not the difference is within a predetermined range (step S105), and when it falls within the predetermined range (when the difference is within the predetermined range), the transfer condition is not changed (step S106), and the transfer condition is used as it is.

That is, when it falls within the predetermined range, the transfer condition is not changed, and the transfer condition is continuously used without being changed.

In contrast, in this exemplary embodiment, when the difference (the amount of comparison deviation) does not fall within the predetermined range (exceeds a predetermined threshold), the processes in step S107 and subsequent steps are performed.

That is, in this exemplary embodiment, when the amount specified by using the information on the amount of deviation acquired by the deviation information acquisition unit 42 exceeds a predetermined threshold, the processes in step S107 and subsequent steps are performed.

In other words, in this exemplary embodiment, when the information acquired by the deviation information acquisition unit 42 satisfies a predetermined condition, the processes in step S107 and subsequent steps are performed, and the transfer condition change unit 41 changes the transfer condition.

In the process in step S107, the transfer condition change unit 41 recognizes a developer with an increased proportion. In other words, in the process in step S107, the transfer condition change unit 41 recognizes which of the proportions of the developers is increased in the deviation detection image.

Then, in step S107, for example, when it is recognized that the developer with the increased proportion is a high-charge developer, the transfer condition change unit 41 decreases the second transfer voltage (step S108).

In contrast, in step S107, for example, when it is recognized that the developer with the increased proportion is a low-charge developer, the transfer condition change unit 41 increases the second transfer voltage (step S109).

In step S104, in this exemplary embodiment, the deviation information acquisition unit 42 acquires information on the deviation of color in the image to be transferred to the sheet P (the information on the comparison deviation).

In this exemplary embodiment, when the information on the deviation of color obtained by the deviation information acquisition unit 42 satisfies a predetermined condition (when the information on the deviation of color indicates occurrence of a deviation of color), the transfer condition change unit 41 changes the second transfer voltage. Thus, the second transfer voltage is increased or decreased.

That is, in this exemplary embodiment, the image reading unit 30 as an example of a reading unit is provided, and when the transfer condition at the second transfer portion 13 is changed, the deviation detection image transferred to the sheet P is first read by the image reading unit 30.

Then, the deviation information acquisition unit 42 analyzes the reading result of the image reading unit 30, and acquires information on the amount of deviation. In this exemplary embodiment, when the amount of deviation exceeds a predetermined threshold, the second transfer voltage is changed.

In step S107, as described above, it is recognized which of the proportions of the developers is increased in the deviation detection image.

In this exemplary embodiment, when it is determined in step S107 that the developer with the increased proportion is the high-charge developer, the transfer condition change unit 41 sets the second transfer voltage to be decreased (step S108).

In other words, when the proportion of the high-charge developer is large in the deviation detection image, the transfer condition change unit 41 sets the second transfer voltage to be decreased.

In contrast, in step S107, when it is recognized that the developer with the increased proportion is the low-charge developer, in step S109, the transfer condition change unit 41 sets the second transfer voltage to be increased. In other words, when the proportion of the low-charge developer is large in the deviation detection image, the transfer condition change unit 41 sets the second transfer voltage to be increased.

Thus, the ratio of the respective developers in the image formed on the sheet P becomes close to the predetermined ratio as compared with that when the second transfer voltage is not changed.

That is, in this exemplary embodiment, an image on the intermediate transfer belt 12 is transferred to a sheet P at the second transfer portion 13 to which the second transfer voltage is applied. When the proportion of a partial developer is increased in a transfer image to be transferred to the sheet P, the transfer condition change unit 41 changes the magnitude of the second transfer voltage to be applied to the second transfer portion 13.

Thus, the ratio of the respective developers in the image (the transfer image) to be transferred from the intermediate transfer belt 12 to the sheet P is changed, and this ratio becomes close to a predetermined ratio.

FIGS. 4A to 4D are diagrams each illustrating a specific example of a change process of the transfer condition.

In this example illustrated in FIGS. 4A to 4D, as illustrated in FIG. 4A, information indicating that a mixture includes a yellow developer and a green developer is acquired as the mixture information.

In addition, in this example, information indicating that the diameter of the yellow developer is larger than that of the green developer is acquired as the mixture information. That is, information on the particle diameter of the yellow developer and the particle diameter of the green developer is obtained as the mixture information.

Further, in this example, ratio information of the developers is acquired as the mixture information.

Specifically, in this example, information on the ratio of the developers, which is the target in the image after transfer to the sheet P, is acquired as the mixture information. More specifically, in this example, information indicating that the ratio of the yellow developer and the green developer is 50:50 is acquired as the mixture information.

In this exemplary embodiment, the mixture information including these pieces of information is acquired in step S101 described above.

Further, in this exemplary embodiment, in step S101, the preset value determined in advance is acquired as the mixture information.

That is, a preset value is also stored in the information storage medium attached to the cartridge, and in step S101, information on this preset value is also acquired.

In this exemplary embodiment, as described above, in step S102, the deviation information acquisition unit 42 determines an index that is used when acquiring the information on the amount of deviation based on the mixture information.

In this example, as indicated by reference sign 4C in FIG. 4B, a case where b* is determined as an index that is used when acquiring the information on the amount of deviation is illustrated.

In this example, as indicated by reference sign 4E, the deviation information acquisition unit 42 acquires the information on the amount of deviation by using the determined index b*.

Specifically, the deviation information acquisition unit 42 acquires the difference between the value of b* obtained from the deviation detection image (the value indicated by reference sign 4F) and the preset value read from the information storage medium (the preset value relating to b*) (the value indicated by reference sign 4G) as the amount of deviation.

In other words, the deviation information acquisition unit 42 acquires the difference between the value of b* obtained from the deviation detection image and the preset value determined in advance (the preset value relating to b*) as a comparison deviation.

That is, in this exemplary embodiment, a preset value is determined in advance for each of a*, b*, and L*, and this preset value is stored in the information storage medium. In other words, in this exemplary embodiment, each preset value obtained by colorimetry or the like of the target image (each preset value generated based on the target image) is stored in the information storage medium.

The deviation information acquisition unit 42 acquires the difference between b* obtained from the deviation detection image and the preset value read from the information storage medium (the preset value determined for b*) as the amount of deviation.

In this exemplary embodiment, it is determined whether or not the amount of deviation acquired by the deviation information acquisition unit 42 exceeds a threshold.

When the amount of deviation exceeds the threshold, the transfer condition change unit 41 changes the transfer condition so that the ratio of the respective developers in the image becomes close to the predetermined ratio as described above.

In other words, the transfer condition change unit 41 changes the transfer condition so that the color of the image formed on the sheet P becomes close to the color of the target image and the comparison deviation is decreased.

More specifically, in this example, as indicated by reference sign 4H in FIG. 4C, the transfer condition change unit 41 decreases the second transfer voltage to be applied to the second transfer portion 13.

Thus, as indicated by reference sign 4J in FIG. 4D, the yellow developer to be transferred to the sheet P is decreased, and the ratio of the respective developers in the image to be transferred to the sheet P becomes close to a predetermined ratio.

In this exemplary embodiment, the transfer condition change unit 41 changes the magnitude (value) of the second transfer voltage to be set in accordance with the magnitude of the amount of deviation acquired by the deviation information acquisition unit 42.

More specifically, the transfer condition change unit 41 changes the magnitude of the second transfer voltage so that the developer with the increased proportion is less likely transferred to the sheet P as the amount of deviation acquired by the deviation information acquisition unit 42 is larger.

FIGS. 5A to 5D are diagrams each illustrating another example of the change process of the transfer condition.

In this example, as illustrated in FIG. 5A, information indicating that a mixture includes a colorless and transparent developer and a black developer is acquired as the mixture information.

Further, in this example, information indicating that the dielectric loss of the colorless and transparent developer is smaller and the dielectric loss of the black developer is larger is acquired as the mixture information. That is, information indicating that the dielectric loss of the colorless and transparent developer is smaller than the dielectric loss of the black developer is acquired as the mixture information.

Further, in this example, the ratio information of the developers is acquired as the mixture information.

Specifically, also in this example, information on the ratio of the developers, which is the target in the image after transfer to the sheet P is acquired as the mixture information. More specifically, in this example, information indicating that the ratio of the colorless and transparent developer and the black developer is 50:50 is acquired as the mixture information.

Further, in this example, as indicated by reference sign 5A in FIG. 5B, a case where a brightness L* is determined as an index that is used when acquiring information on the amount of deviation is illustrated.

In this case, the deviation information acquisition unit 42 acquires information on the amount of deviation by using the determined index L*.

More specifically, the deviation information acquisition unit 42 acquires the difference between the value of L* obtained from the deviation detection image (the value indicated by reference sign 5B) and the preset value read from the information storage medium (the preset value relating to L*) (the preset value indicated by reference sign 5C) as the amount of deviation.

In other words, the deviation information acquisition unit 42 acquires the difference between the value of L* obtained from the deviation detection image and the preset value determined in advance (the preset value relating to L*) as a comparison deviation.

In this case as well, it is determined whether or not the acquired amount of deviation exceeds the threshold similarly to the above description. Then, if the amount of deviation exceeds the threshold, the transfer condition is changed so that the ratio of the respective developers becomes close to the predetermined ratio similarly to the above description.

More specifically, also in this case, as indicated by reference sign 5D in FIG. 5C, the transfer condition change unit 41 decreases the second transfer voltage to be applied to the second transfer portion 13.

Thus, as indicated by reference sign 5F in FIG. 5D, the colorless and transparent developer to be transferred to the sheet P is decreased, and the ratio of the respective developers in the image to be transferred to the sheet P becomes close to the predetermined ratio.

Similarly to the above description, the transfer condition change unit 41 changes the magnitude of the second transfer voltage so that the developer with the increased proportion is less likely transferred to the sheet P as the amount of deviation acquired by the deviation information acquisition unit 42 is larger.

More specifically, the transfer condition change unit 41 decreases the magnitude of the second transfer voltage as the amount of deviation acquired by the deviation information acquisition unit 42 is increased.

In this exemplary embodiment, in the transfer image to be transferred to the sheet P, the transfer condition change unit 41 decreases the second transfer voltage to be applied to the second transfer portion 13 in a case where the amount of one kind of developer that likely moves when an electric field is applied is larger than the amount of another kind of developer that less likely moves than the one kind of developer.

In other words, the transfer condition change unit 41 decreases the second transfer voltage to be applied to the second transfer portion 13 when the proportion of the one kind of developer is larger than the predetermined proportion (the intended proportion) in the transfer image to be transferred to the sheet P and hence the proportion of the one kind of developer is increased.

Thus, the one kind of developer that likely moves when an electric field is applied becomes less likely to move toward the sheet P, and the proportion of the one kind of developer in the image to be formed on the sheet P is decreased.

Examples of the one kind of developer that likely moves when an electric field is applied include a high-charge developer, a developer having a large particle diameter, a developer having a small dielectric loss, and a developer including no metal pigment.

In this exemplary embodiment, when the ratio of the developers is larger than the intended ratio in the transfer image, the second transfer voltage to be applied to the second transfer portion 13 is decreased.

Thus, the one kind of developer becomes less likely to move, and the proportion of the one kind of developer in the image to be formed on the sheet P is decreased.

In contrast, the transfer condition change unit 41 increases the second transfer voltage to be applied to the second transfer portion 13 when the proportion of the other kind of developer is larger than the predetermined ratio and the proportion of the other kind of developer is increased in the transfer image to be transferred to the sheet P.

That is, in this exemplary embodiment, when the proportion of the other kind of developer is larger than the intended proportion in the transfer image such as the deviation detection image described above, which is to be transferred to the sheet P, the second transfer voltage is increased.

Thus, the other kind of developer becomes less likely to move toward the sheet P, and the proportion of the other kind of developer is decreased in the image formed on the sheet P.

Examples of the other kind of developer that less likely moves when an electric field is applied include a low-charge developer, a developer having a small particle diameter, a developer having a large dielectric loss, and a developer including a metal pigment.

In this exemplary embodiment, when the ratio of the developers is increased in the transfer image, the second transfer voltage to be applied to the second transfer portion 13 is increased.

Thus, the other kind of developer becomes less likely to move toward the sheet P, and the proportion of the other kind of developer is decreased in the image formed on the sheet P.

Figure 6:
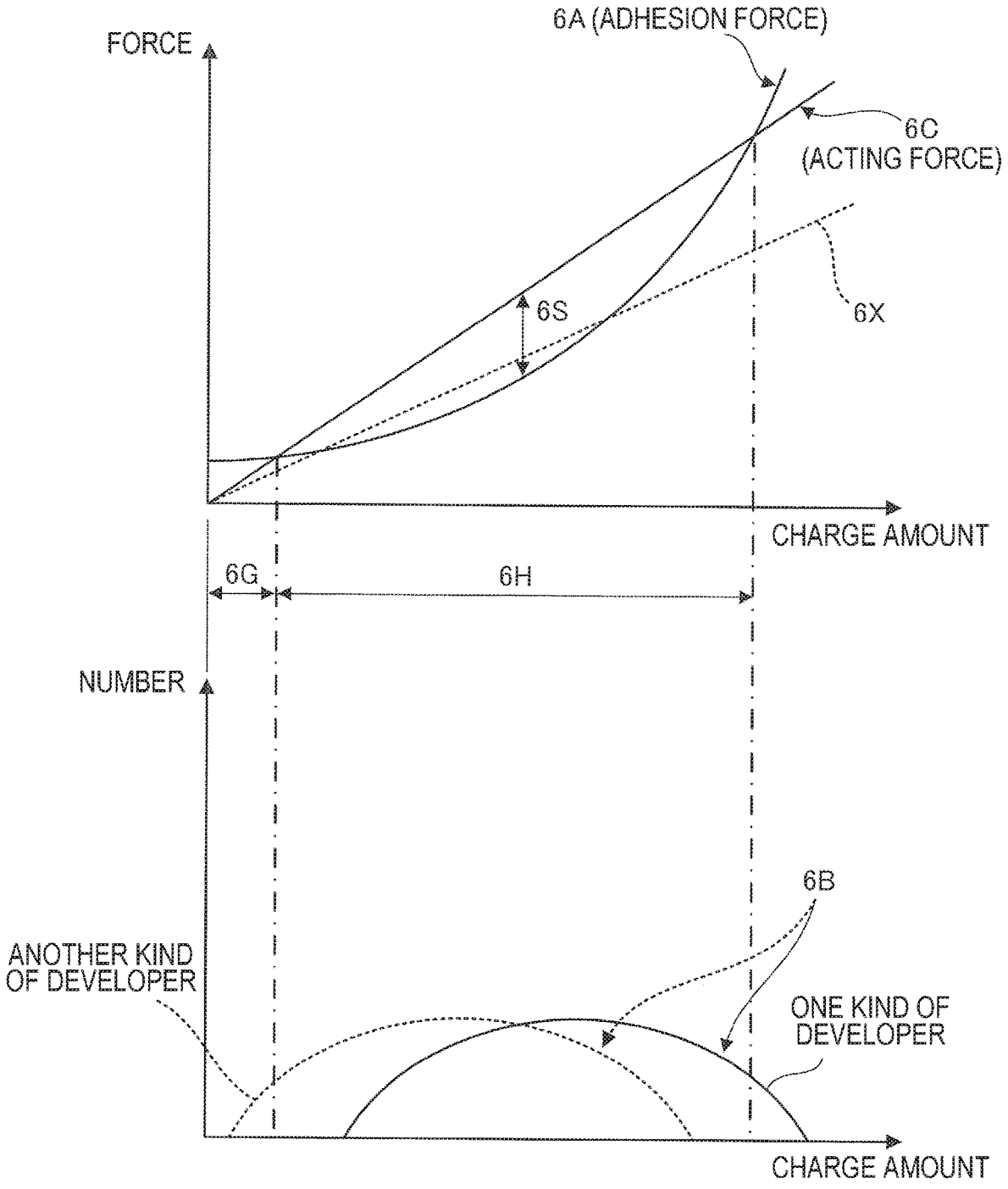
FIG. 6 is a diagram for explaining an influence when a second transfer voltage is decreased.

FIG. 6 is a diagram for explaining an influence when the second transfer voltage is decreased.

In a mixture including two or more kinds of developers, the charge amount may vary on the developer basis as indicated by reference sign 6B, like the high-charge developer and the low-charge developer.

More specifically, while the reference sign 6B indicates the charge amount (distribution of the charge amount) of each developer in the mixture of the one kind of developer and the other kind of developer, in this example, the one kind of developer involves more developer whose charge amount is large than the other kind of developer.

A curve 6A in FIG. 6 indicates the adhesion force between the intermediate transfer belt 12 and the developer.

A straight line 6C in FIG. 6 indicates the acting force acting on the developer when the second transfer voltage is applied to the second transfer portion 13 (hereinafter referred to as "acting force"). That is, the straight line 6C indicates the acting force acting on the developer when an electric field is applied to the developer.

In this exemplary embodiment, as indicated by the straight line 6C, the acting force acting on the developer becomes larger as the charge amount of the developer is larger.

In addition, as indicated by the curve 6A, the adhesion force acting between the intermediate transfer belt 12 and the developer becomes larger as the charge amount of the developer is larger.

In this exemplary embodiment, when the adhesion force is larger than the acting force, the developer continuously adheres to the intermediate transfer belt 12, and the developer less likely moves to the sheet P.

In contrast, within the range indicated by reference sign 6H, the acting force becomes larger than the adhesion force, and the developer is separated from the intermediate transfer belt 12, and the developer moves toward the sheet P.

In this example, the one kind of developer involves more developer whose acting force is larger than the adhesion force as compared with the other kind of developer.

In this case, the one kind of developer is more likely separated from the intermediate transfer belt 12 than the other kind of developer. In this case, the one kind of developer becomes more likely to move to the sheet P than the other kind of developer.

Further, in this example, when a difference 6S between the adhesion force and the acting force is compared, the difference in the one kind of developer tends to be larger than the difference in the other kind of developer.

In addition, within the range indicated by reference sign 6G, the adhesive force acting between the other kind of developer and the intermediate transfer belt 12 is larger than the acting force acting on the other kind of developer. In this case, the other kind of developer less likely moves to the sheet P within the range indicated by reference sign 6G.

Consequently, in this example, the one kind of developer moves more to the sheet P than the other kind of developer, and as described above, the situation in which the proportion of the one kind of developer is increased may occur.

In such a situation, when the second transfer voltage is decreased as described above, the inclination of the straight line indicating the acting force acting on the developer is decreased as indicated by reference sign 6X.

In this case, the amount of the one kind of developer that moves to the sheet P is relatively decreased, and the amount of the other kind of developer that moves to the sheet P is relatively increased.

Thus, the ratio of the one kind of developer and the other kind of developer becomes close to the predetermined ratio.

Figure 7:
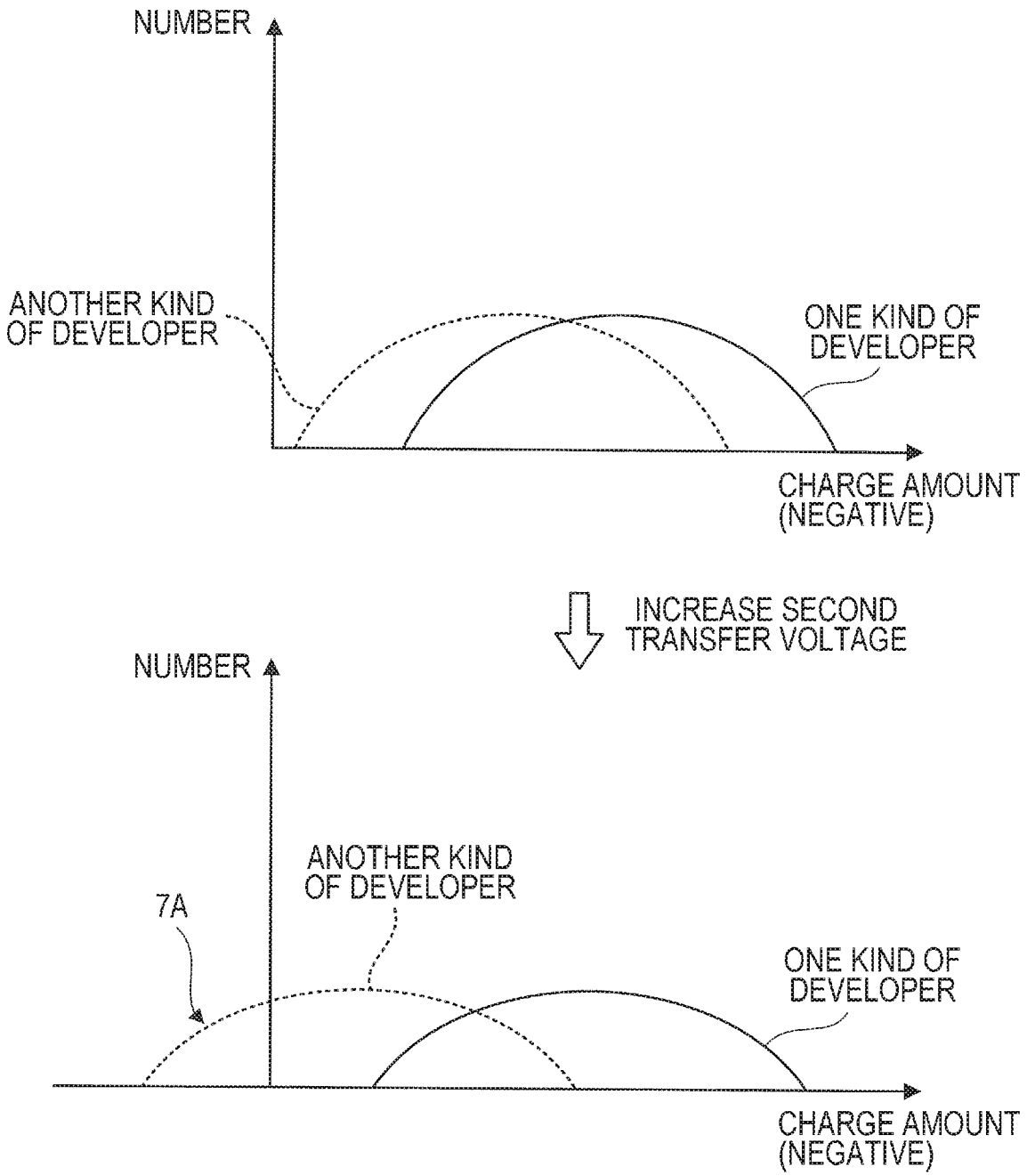
FIG. 7 is a diagram for explaining an influence when the second transfer voltage is increased.

FIG. 7 is a diagram for explaining an influence when the second transfer voltage is increased.

When the second transfer voltage is increased, a positive electric charge is injected to the other kind of developer that is negatively charged by a small charge amount, and a portion of the other kind of developer is positively charged as indicated by reference sign 7A.

In this case, the portion of the developer becomes less likely to move toward the sheet P, and the proportion of the other kind of developer is decreased in the transfer image.

That is, in this exemplary embodiment, in the transfer image, when the proportion of the other kind of developer such as the low-charge developer is increased, the second transfer voltage is increased as described above.

Thus, the charging polarity of the portion of the other kind of developer is changed, and the other kind of developer becomes less likely to move toward the sheet P. Thus, the proportion of the other kind of developer is decreased in the transfer image.

In this embodiment, as described above, the index that is used when acquiring the information on the amount of deviation is determined based on the mixture information.

Then, the information on the amount of deviation is acquired by using the determined index. In other words, the comparison deviation is recognized by using the determined index.

Thus, as compared with the case where the amount of deviation is acquired by using only one fixed index, it is possible to more accurately recognize the amount of deviation.

When the ratio of the developers in the transfer image is changed, the change likely appears in a specific index, rather than uniformly appearing in each of all indices.

For example, when the developers included in the mixture are a colorless and transparent developer and a black developer, if the ratio of the developers is changed, this change likely appears in brightness.

In addition, when the developers included in the mixture are a yellow developer and a green developer, if the ratio of the developers is changed, the change in ratio more likely appears in a* and b*. In particular, the change more likely appears in b*.

Thus, in this embodiment, as described above, the index that is used when acquiring the information on the amount of deviation is determined based on the mixture information. In this case, the index serves as an index based on the contents of the mixture, and the amount of deviation of color may be more accurately recognized.

Other Configurations

When changing the transfer condition to a new transfer condition, the transfer condition change unit 41 may change the transfer condition gradually (change the transfer condition sequentially), specify a transfer condition under which the above-described comparison deviation falls within the predetermined range, and recognize the specified transfer condition as a new transfer condition.

More specifically, in this case, the transfer condition change unit 41 changes the transfer condition sequentially, and further recognizes the comparison deviation every time when the transfer condition is changed.

Then, when the comparison deviation falls within the predetermined range, the transfer condition change unit 41 sets the transfer condition at this time as a new transfer condition.

More specifically, in this case, the transfer condition change unit 41 changes the second transfer voltage sequentially so that the value of the second transfer voltage to be applied to the second transfer portion 13 is gradually increased or gradually decreased. Further, every time when the transfer condition change unit 41 changes the second transfer voltage, the transfer condition change unit 41 recognizes the comparison deviation of the transfer image to be formed.

Then, the transfer condition change unit 41 specifies the second transfer voltage when the comparison deviation falls within the predetermined range, and sets the specified second transfer voltage as a new second transfer voltage.

Alternatively, to change the transfer condition to a new transfer condition by gradually changing the transfer condition, the transfer condition change unit 41 may specify a transfer condition with the minimum comparison deviation, and use the specified transfer condition as a new transfer condition.

When performing this process, the transfer condition change unit 41 continues to change the transfer condition even when the comparison deviation falls within the predetermined range.

In this case, the value of the comparison deviation obtained may be gradually decreased, the value of the comparison deviation may be minimized, and then the value of the comparison deviation may be increased. When this situation occurs, the transfer condition change unit 41 specifies the transfer condition under which the value of the comparison deviation is minimized.

Then, the transfer condition change unit 41 sets the transfer condition that the value of the comparison deviation is minimized as a new transfer condition.

The process of decreasing the comparison deviation is not limited to the case where the process is performed in a dedicated mode for performing the process, and may be performed, for example, during normal image formation.

More specifically, for example, every time when an image is formed using an extra color, the transfer condition is changed. Thus, the transfer condition is gradually changed as described above.

Then, every time when the transfer condition is changed, the reading result of the transfer image formed on the sheet P is analyzed, and the comparison deviation is acquired.

When the comparison deviation that has been larger than the predetermined threshold becomes smaller than the predetermined threshold when a certain transfer condition is used, the transfer condition is used hereinafter.

In this case, even if the process in the dedicated mode is not performed (a dedicated process for decreasing the comparison deviation), the transfer condition is a transfer condition under which the deviation of color unlikely occurs.

Modifications

In the above description, the case has been described in which the reading result obtained by the image reading unit 30 is analyzed, and when the result of the analysis satisfies the predetermined condition (when the amount of deviation exceeds the predetermined threshold), the change process of the transfer condition is performed.

The change process is not limited to this, and for example, the change process may be performed in response to an instruction from an operator. Specifically, for example, the change process may be performed in response to an instruction from an operator who has visually confirmed the transfer image.

More specifically, for example, an inquiry such as "Is the image yellowish?" or the like may be made to a user, and when the response of "yellowish" is made from the user, the change process of the transfer condition may be performed.

In this case, the deviation information acquisition unit 42 acquires information indicating being yellowish as the information on the deviation of color.

Although the process in the image forming apparatus 1 that transfers an image to a sheet P via the intermediate transfer belt 12 has been described as an example in the above description, the above-described process may also be performed in an image forming apparatus 1 that directly transfers an image from the photoconductor drum 111 to a sheet P.

In this case as well, the color of the image becomes close to the intended color by changing the transfer condition in accordance with the deviation of color in the image formed on the sheet P.

In addition, in the above description, the information on, for example, hue, brightness, and saturation are obtained from the reading result obtained by the image reading unit 30 provided in the image forming apparatus 1. In other words, in the above description, the information on the color of the transfer image is obtained based on the reading result obtained by the image reading unit 30 provided in the image forming apparatus 1.

However, without limited to this, the information on, for example, hue, brightness, and saturation may be acquired by using a portable colorimeter to acquire the information on the color of the transfer image.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiments was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

an image holding body that holds an image to be transferred to a recording material;

a developing unit that causes a mixture, in which a plurality of kinds of developers are mixed, to adhere to the image holding body and that forms an image on the image holding body;

a transfer unit that transfers an image formed on the image holding body to a recording material; and a change portion that changes a transfer condition that is a condition under which the transfer unit performs transfer so that a ratio of the plurality of kinds of developers in the image to be transferred to a recording material becomes close to a predetermined ratio.

2. The image forming apparatus according to claim 1, further comprising:

a deviation information acquisition portion that acquires information on a deviation of color in the image to be transferred to a recording material, wherein, when the information acquired by the deviation information acquisition portion satisfies a predetermined condition, the change portion changes the transfer condition.

3. The image forming apparatus according to claim 2, further comprising:

a reading unit that reads the image transferred to a recording material, wherein the deviation information acquisition portion analyzes a reading result of the reading unit and acquires information on an amount of the deviation, and wherein the change portion changes the transfer condition when an amount specified by using the information on the amount of the deviation exceeds a predetermined threshold.

4. The image forming apparatus according to claim 3, wherein the deviation information acquisition portion determines an index that is used when acquiring the information on the amount of the deviation based on information on the mixture, and acquires the information on the amount of the deviation by using the determined index.

5. The image forming apparatus according to claim 1, wherein an image on the image holding body is transferred to a recording material at a transfer portion at which the image is transferred to the recording material and to which a voltage is applied, and wherein the change portion changes a magnitude of the voltage to be applied to the transfer portion so that the ratio of the plurality of kinds of developers becomes close to the predetermined ratio.

6. The image forming apparatus according to claim 5, wherein the mixture includes one kind of developer that more likely moves when an electric field is applied, and another kind of developer that less likely moves than the one kind of developer, wherein a transfer image that is formed on a recording material by transferring an image formed with the mixture to the recording material includes the one kind of developer and the other kind of developer, and wherein, when a proportion in the transfer image of the one kind of developer that more likely moves when a voltage is applied is larger than a predetermined proportion, the change portion decreases the voltage to be applied to the transfer portion.

7. The image forming apparatus according to claim 5, wherein the mixture includes one kind of developer that more likely moves when an electric field is applied, and another kind of developer that less likely moves than the one kind of developer, wherein a transfer image that is formed on a recording material by transferring an image formed with the mixture to the recording material includes the one kind of developer and the other kind of developer, and wherein, when a proportion in the transfer image of the other kind of developer that less likely moves when a voltage is applied is larger than a predetermined proportion, the change portion increases the voltage to be applied to the transfer portion.

8. The image forming apparatus according to claim 1, wherein a comparison deviation is specified, the comparison deviation being a deviation of color in an image to be transferred to a recording material and being a deviation of color in a case where a color of an image formed with the plurality of kinds of developers at the predetermined ratio is used as a comparison object, and wherein, when changing the transfer condition to a new transfer condition, the change portion gradually changes the transfer condition, specifies a transfer condition under which the comparison deviation falls within a predetermined range, and sets the specified transfer condition as the new transfer condition.

9. The image forming apparatus according to claim 8, wherein the change portion gradually changes the transfer condition, specifies a transfer condition under which the comparison deviation is minimized, and sets the specified transfer condition as the new transfer condition.

10. The image forming apparatus according to claim 8, wherein an image on the image holding body is transferred to a recording material at a transfer portion at which the image is transferred to the recording material and to which a voltage is applied, and wherein the change portion gradually changes the voltage so that a value of the voltage to be applied to the transfer portion is gradually increased or gradually decreased, and specifies a voltage with which the comparison deviation falls within the predetermined range, and sets the specified voltage as the new transfer condition.

11. An image forming apparatus comprising:

an image holding body that holds an image to be transferred to a recording material;

developing means for causing a mixture, in which a plurality of kinds of developers are mixed, to adhere to the image holding body and forming an image on the image holding body;

transfer means for transferring an image formed on the image holding body to a recording material; and change means for changing a transfer condition that is a condition under which the transfer means performs transfer so that a ratio of the plurality of kinds of developers in the image to be transferred to a recording material becomes close to a predetermined ratio.

* * * * *